US005127477A

United States Patent [19]

Schultz

[11] Patent Number: 5,127,477

[45] Date of Patent: Jul. 7, 1992

[54] RECHARGEABLE HYDRAULIC POWER SOURCE FOR ACTUATING DOWNHOLE TOOL

[75] Inventor: Roger L. Schultz, Richardson, Tex.

[73] Assignee: Halliburton Company, Duncan, Okla.

[21] Appl. No.: 658,120

[22] Filed: Feb. 20, 1991

[51] Int. Cl.[5] ..... E21B 49/08

[52] U.S. Cl. ..... 166/336; 166/250; 166/373; 166/324

[58] Field of Search ..... 166/250, 264, 321, 324, 166/336, 380

[56] References Cited

U.S. PATENT DOCUMENTS

| | | | |
|---|---|---|---|
| 3,856,085 | 12/1974 | Holden et al. | 166/264 |
| 4,113,012 | 9/1978 | Evans et al. | 166/264 |
| 4,347,900 | 9/1982 | Barrington | 166/380 |
| 4,375,239 | 3/1983 | Barrington et al. | 166/336 |
| 4,378,850 | 4/1983 | Barrington | 166/373 |
| 4,422,506 | 12/1983 | Beck | 166/324 |
| 4,440,230 | 4/1984 | McGill | 166/324 |
| 4,711,305 | 12/1987 | Ringgenberg | 166/336 |
| 4,736,798 | 4/1988 | Zunkel | 166/321 |
| 4,796,699 | 1/1989 | Upchurch | 166/250 |
| 4,856,595 | 8/1989 | Upchurch | 166/374 |
| 4,866,607 | 9/1989 | Anderson et al. | 364/422 |
| 4,896,722 | 1/1990 | Upchurch | 166/250 |
| 4,911,242 | 3/1990 | Hromas et al. | 166/321 |
| 4,915,168 | 4/1990 | Upchurch | 166/250 |
| 4,979,568 | 12/1990 | Spencer, III et al. | 166/321 |

*Primary Examiner*—Ramon S. Britts
*Assistant Examiner*—Frank S. Tsay
*Attorney, Agent, or Firm*—C. Dean Domingue; L. Wayne Beavers

[57] ABSTRACT

A downhole tool includes a hydraulic power supply containing a volume of compressed gas. The hydraulic power supply can be recharged while the tool is located downhole in the well by recompressing the gas in the power supply chamber.

45 Claims, 3 Drawing Sheets

RECHARGEABLE HYDRAULIC POWER SOURCE FOR ACTUATING DOWNHOLE TOOL

BACKGROUND OF THE INVENTION

1. Field of the Invention

The present invention relates generally to a system for actuating downhole tools in response to a pressure differential.

2. Description of the Prior Art

The basic function of most downhole tools involves surface manipulation of a downhole operation system to accomplish a task such as opening a valve, for example the opening and closing of a tester valve or a circulation valve.

This process usually involves a linear actuator, i.e., a power piston, which works off a pressure differential acting across a hydraulic area.

There are several ways in which this pressure differential can be achieved to operate such a linear actuator.

One technique is the use of a nitrogen charged system in which the nitrogen acts as a spring which supports hydrostatic well annulus pressure, but which can be further compressed with applied pressure at the surface allowing linear actuation across a hydraulic area downhole. An example of such a tool is seen in Ringgenberg U.S. Pat. No. 4,711,305 to Ringgenberg.

Yet another system provides first and second pressure conducting passages from either side of the power piston to the well annulus. A metering orifice type of retarding means is disposed in the second pressure conducting passage for providing a time delay in communication of changes in well annulus pressure to the second side of the power piston. Accordingly, a rapid increase or rapid decrease in well annulus pressure causes a temporary pressure differential across the piston which moves the piston. An example of such a system is seen in Beck U.S. Pat. No. 4,422,506.

Still another approach is to provide both high and low pressure sources within the tool itself by providing a pressurized hydraulic fluid supply and an essentially atmospheric pressure dump chamber. Such an approach is seen in Barrington et al U.S. Pat. No. 4,375,239.

Another approach is to utilize the well annulus pressure as a high pressure source, and to provide an essentially atmospheric pressure dump chamber as the low pressure zone within the tool itself. Such an approach is seen in Upchurch U.S. Pat. Nos. 4,796,699; 4,856,595; 4,915,168; and 4,896,722.

SUMMARY OF THE INVENTION

The present invention relates to a differential pressure actuation system which utilizes a high pressure source defined within the tool by a high pressure supply chamber which contains a volume of compressed gas to provide the high pressure. The low pressure reference for this system is a low pressure zone of the well, preferably a well annulus which surrounds the downhole tool. The low pressure zone can also be the interior of a tubing string.

The present invention also includes a recharging means for recharging the high pressure supply chamber while the tool is in place downhole within the well.

The recharging means includes a bypass conduit for bypassing a power transfer element of the tool and directly communicating the high pressure supply chamber with the low pressure zone of the well. A bypass check valve is disposed in the bypass conduit. The check valve prevents communication of fluid pressure therethrough from the high pressure supply chamber to the low pressure zone of the well when the pressure in the high pressure supply chamber is greater than that in the low pressure zone of the well. The check valve permits communication of fluid pressure from the low pressure zone of the well through the bypass conduit to the high pressure supply chamber when fluid pressure in the low pressure zone of the well is greater than that in the high pressure supply chamber.

Thus, the high pressure supply chamber can be recharged after the compressed gas has expanded to substantially deplete the high pressure supply chamber. This is accomplished by increasing pressure on the low pressure zone of the well until it is greater than the pressure in the high pressure supply chamber, and communicating this increased pressure to the high pressure supply chamber through the bypass conduit. The low pressure zone of the well preferably is the well annulus and the well pressure therein is increased by applying pressure at the upper end of a column of fluid standing in the well annulus.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

The Background Environment Of The Invention

It is appropriate at this point to provide a description of the environment in which the present invention is used. During the course of drilling an oil well, the bore hole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole. Drilling fluids and formation fluids can all be generally referred to as well fluids.

When it is desired to test the production capabilities of the formation, a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole, thus closing the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

At other times the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or may be for the purpose of permitting pressure testing of the test string as it is lowered into the well.

The well testing program includes intervals of formation flow and intervals when the formation is closed in. Pressure recordings are taken throughout the program for later analysis to determine the production capability of the formation. If desired, a sample of the formation fluid may be caught in a suitable sample chamber.

At the end of the well testing program, a circulation valve in the test string is opened, formation fluid in the testing string is circulated out, the packer is released, and the testing string is withdrawn.

Figure 1:
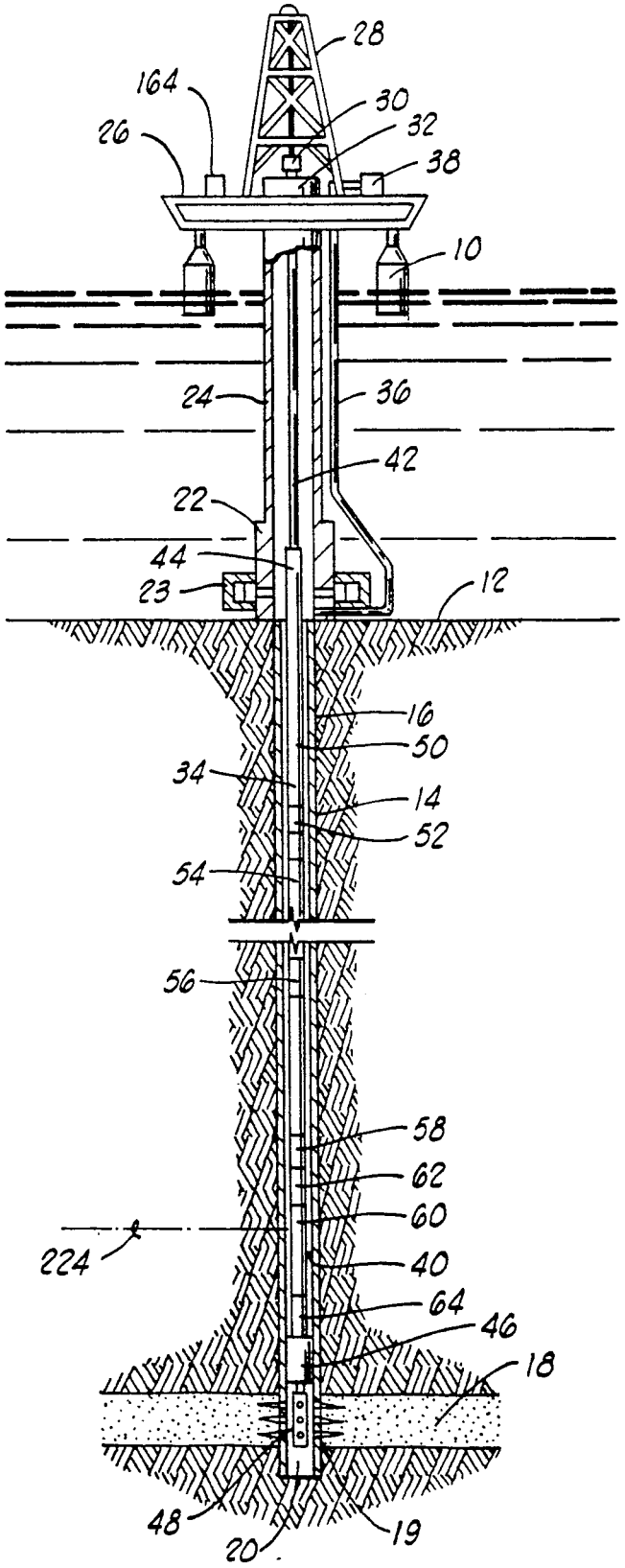
FIG. 1 is an elevation schematic view of a typical well test string in which the present invention may be incorporated.

A typical arrangement for conducting a drill stem test offshore is shown in FIG. 1. Of course, the present invention may also be used on wells located onshore.

The arrangement of the offshore system includes a floating work station 10 stationed over a submerged work site 12. The well comprises a well bore 14, which typically is lined with a casing string 16 extending from the work site 12 to a submerged formation 18. It will be appreciated, however, that the present invention can also be used to test a well which has not yet had the casing set therein.

The casing string includes a plurality of perforations 19 at its lower end which provide communication between the formation 18 and a lower interior zone or annulus 20 of the well bore 14.

At the submerged well site 12 is located the well head installation 22 which includes blowout preventer mechanisms 23. A marine conductor 24 extends from the well head installation 22 to the floating work station 10. The floating work station 10 includes a work deck 26 which supports a derrick 28. The derrick 28 supports a hoisting means 30. A well head closure 32 is provided at the upper end of the marine conductor 24. The well head closure 32 allows for lowering into the marine conductor and into the well bore 14 a formation testing string 34 which is raised and lowered in the well by the hoisting means 30. The testing string 34 may also generally be referred to as a tubing string 34.

A supply conduct 36 is provided which extends from a hydraulic pump 38 on the deck 26 of the floating station 10 and extends to the well head installation 22 at a point below the blowout preventer 23 to allow the pressurizing of the well annulus 40 defined between the testing string 34 and the well bore 14.

The testing string 34 includes an upper conduit string portion 42 extending from the work deck 26 to the well head installation 22. A subsea test tree 44 is located at the lower end of the upper conduit string 42 and is landed in the well head installation 22.

The lower portion of the formation testing string 34 extends from the test tree 44 to the formation 18. A packer mechanism 46 isolates the formation 18 from fluids in the well annulus 40. Thus, an interior or tubing string bore of the tubing string 34 is isolated from the upper well annulus 40 above packer 46. Also, the upper well annulus 40 above packer 46 is isolated from the lower zone 20 of the well which is often referred to as the rat hole 20.

A perforated tail piece 48 provided at the lower end of the testing string 34 allows fluid communication between the formation 18 and the interior of the tubular formation testing string 34.

The lower portion of the formation testing string 34 further includes intermediate conduit portion 50 and torque transmitting pressure and volume balanced slip joint means 52. An intermediate conduit portion 54 is provided for imparting packer setting weight to the packer mechanism 46 at the lower end of the string.

It is many times desirable to place near the lower end of the testing string 34 a circulation valve 56 which may be opened by rotation or reciprocation of the testing string or a combination of both or by dropping of a weighted bar in the interior of the testing string 34. Below circulating valve 56 there may be located a combination sampler valve section and reverse circulation valve 58.

Also near the lower end of the formation testing string 34 is located a formation tester valve 60. Immediately above the formation tester valve 60 there may be located a drill pipe tester valve 62.

A pressure recording device 64 is located below the formation tester valve 60. The pressure recording device 64 is preferably one which provides a full opening passageway through the center of the pressure recorder to provide a full opening passageway through the entire length of the formation testing string.

The present invention relates to a system for actuating various ones of the tools found in such a testing string 34, and relates to novel constructions of such tools designed for use with this new actuating system. Typical examples of the tools to which this new actuating system may be applied would be the formation tester valve 60 and/or the reverse circulating valve 58.

Figure 2:
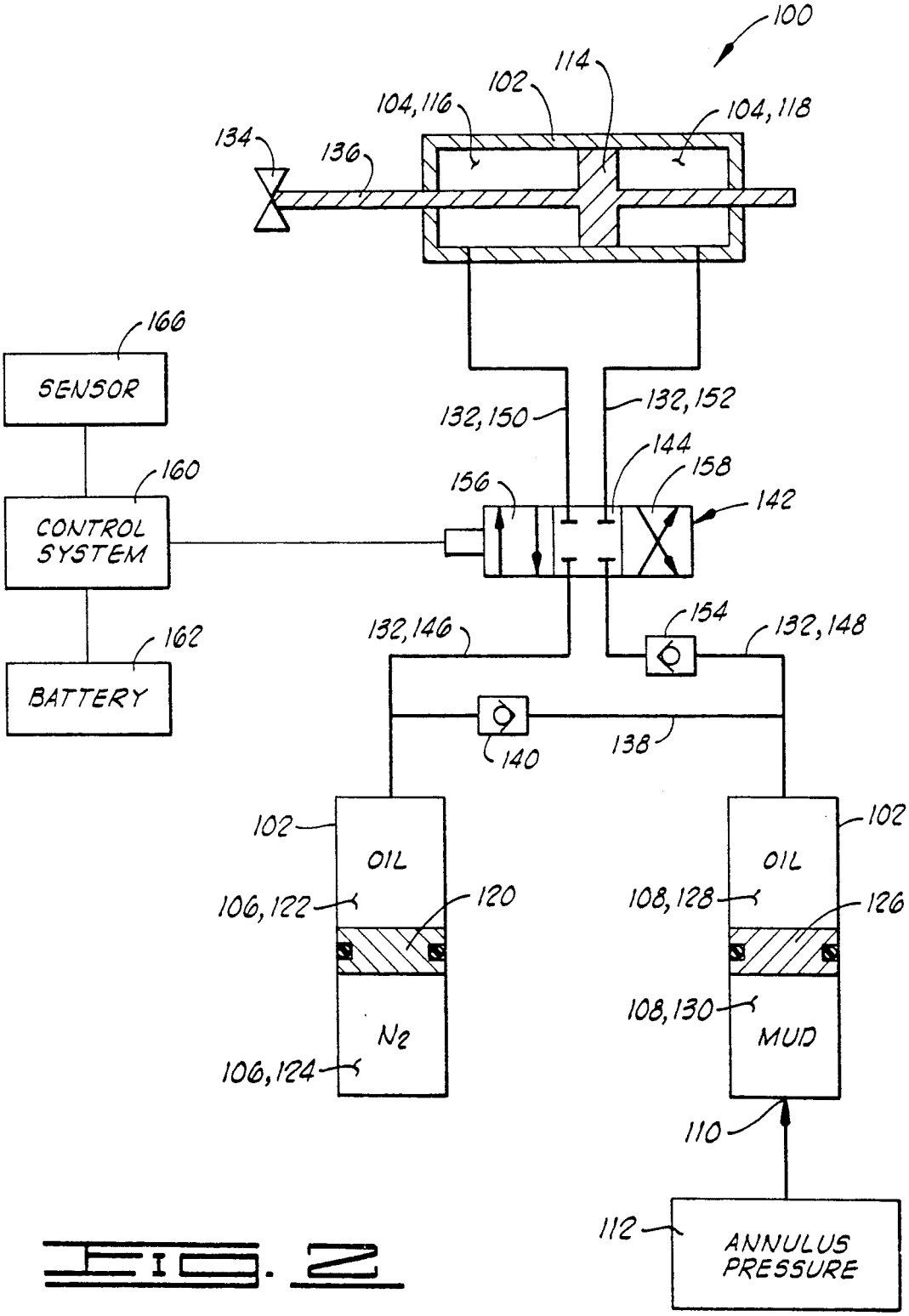
FIG. 2 is a schematic illustration of a downhole tool incorporating the hydraulic system of the present invention as applied to a power piston type of power transfer element.

The Embodiment Of FIG. 2

FIG. 2 schematically illustrates one embodiment of a downhole tool utilizing the present invention. In FIG. 2 a downhole tool apparatus is shown schematically and is generally designated by the numeral 100. The downhole tool apparatus 100 is a tool for use in a well such as that previously described with regard to FIG. 1. The downhole tool 100 may, for example, be a formation tester valve in the location shown as 60 in FIG. 1, or a reverse circulating valve in the location shown as 58 in FIG. 1. The present invention could also be used with other ones of the tools shown in the tool string of FIG. 1, and with other types of downhole tools in general.

The tool 100 includes a housing which is schematically illustrated in FIG. 2 and designated by the numeral 102. The housing 102 has a power chamber 104, a high pressure supply chamber 106, and an isolation chamber 108 defined therein. The housing 102 further has a port means 110 defined therein for communicating the isolation chamber 108 with a low pressure zone 112 of the well. The low pressure zone 112 may be the well annulus 40 of FIG. 1. The low pressure zone 112 may also be the interior of the tubing string 34 (see FIG. 1) upon which the apparatus 100 is conveyed into the well. In the preferred embodiments described herein the low pressure zone 112 is the same as the well annulus 40.

A power transfer element 114 is disposed in the power chamber 104. In the embodiment of FIG. 2 the power transfer element 114 is a linear power transfer element generally referred to as a power piston 114 which reciprocates within the power chamber 104. The power piston 114 separates the power chamber 104 into first and second power chamber portions 116 and 118.

A pressure transfer piston 120 is slidably disposed in the supply chamber 106 and divides the supply chamber 106 into first and second supply chamber portions 122 and 124, respectively. The second supply chamber portion 124 is filled with a compressible fluid to provide a high pressure source. The compressible fluid in the second supply chamber portion 124 is preferably compressed nitrogen gas. It will be understood that in the broader sense of the invention other compressible fluids could be utilized, even including compressible liquids such as silicone oil.

An isolation piston 126 is slidably disposed in the isolation chamber 108 and divides the isolation chamber 108 into first and second isolation chamber portions 128 and 130, respectively. The second isolation chamber portion 130 is in fluid flow communication through the port means 110 with the low pressure zone 112 of the well. Well fluid from the annulus 40 can flow through the port 110 into the second isolation chamber portion 130

Also defined in the apparatus 100 is a power passage means generally designated by the numeral 132 for communicating the power chamber 104 with the first portion 122 of the supply chamber 106 and with the first portion 128 of the isolation chamber 108. Thus, a pressure differential between the high pressure source, i.e., the nitrogen gas in second supply chamber portion 124, and the low pressure zone 112 of the well is applied to the power piston 114 to operate the downhole tool apparatus 100.

Power piston 114 is schematically illustrated in FIG. 2 as being connected to an operating element 134 through an actuating mechanism 136. The operating element 134 may be of many different varieties corresponding to the various tools within the testing string 34 illustrated in FIG. 1 and previously described.

For example, the operating element 134 may be a rotating ball valve type element of a formation tester valve 60 having an operating mechanism substantially like that shown in Holden et al. U.S. Pat. No. 3,856,085, the details of which are incorporated herein by reference.

As another example, the operating element 134 could be a sliding sleeve valve of a recloseable reverse circulation valve 58 having an associated operating mechanism 136 substantially like that shown in Evans et al. U.S. Pat. No. 4,113,012, the details of which are incorporated herein by reference. Preferably, the indexing system of the Evans et al. tool would be deleted Also a multi-mode operating element could be used substantially like that shown in Ringgenberg U.S. Pat. No. 4,711,305, the details of which are incorporated by reference.

The apparatus 100 also has defined therein a bypass conduit means 138 for bypassing the power chamber 104 and directly communicating the first supply chamber portion 122 and the first isolation chamber portion 128 with each other. A bypass check valve means 140 is disposed in the bypass conduit means 138 for permitting flow of hydraulic fluid and thus the communication of fluid pressure from the first isolation chamber portion 128 through the bypass conduit means 138 to the first supply chamber portion 122 to recompress the compressed gas in second supply chamber portion 124, as is further described below, when fluid pressure in the low pressure zone 112 of the well is increased to a level greater than the pressure of the gas in second supply chamber portion 124.

The power chamber 104, the first portion 122 of supply chamber 106, the first portion 128 of isolation chamber 108, the power passage means 132 and the bypass conduit means 138 are all filled with a clean hydraulic fluid, preferably oil.

A three position, normally closed electric solenoid control valve means 142 is disposed in the power passage means 132 for controlling communication of the power chamber 104 with the supply chamber 102 and isolation chamber 108. The control valve 142 is shown in FIG. 2 in its closed position 144.

The power passage means 132 is made up of four power passage segments 146, 148, 150 and 152.

The power passage segment 146 can generally be described as a high pressure supply passage 146 for communicating high pressure from the supply chamber 106 to the power chamber 104. The power passage segment 148 can generally be described as a low pressure discharge passage 148 for communicating the power chamber 104 with the isolation chamber 108. A discharge check valve means 154 is disposed in the discharge passage 148 for preventing flow of hydraulic fluid from the isolation chamber 108 toward the power chamber 104.

The control valve means 142 has a first open position 156 wherein the first portion 122 of supply chamber 106 is communicated with the first portion 116 of power chamber 104 and the second portion 118 of power chamber 104 is communicated with the first portion 128 of isolation chamber 108 so that a pressure differential acts in a first direction from left to right as seen in FIG. 2 across the power piston 114.

The control valve means has a second open position 158 wherein the first portion 122 of supply chamber 106 is communicated with the second portion 118 of power chamber 104, and the first portion 116 of power chamber 104 is communicated with a first portion 128 of isolation chamber 108, so that the pressure differential between the nitrogen gas in second supply chamber portion 124 and the low pressure reference in zone 112 acts across the power piston 114 in a second direction from right to left as seen in FIG. 2.

Thus, the power piston 114 can be moved between two operating positions thereof by placing the control valve means 142 in a selected one of its first and second open positions 156 and 158. These two operating positions will typically correspond to an open and a closed position of the operating element 134. Also, the control valve means 142 may be put in its normally closed position 144 by cutting the supply of electrical power thereto. When the control valve means 142 is in its closed position 144 the power piston 114 is hydraulically locked in whichever one of its first and second operating positions it was in previously.

Also, when the control valve means 142 is in its normally closed position 144, which could be referred to as a third position 144, the power chamber 104 is isolated from the supply chamber 106.

Preferably, the control valve means 142 is operated by a microprocessor based control system 160. The control system 160 is powered by an electrical power source 162 which may be batteries. Preferably, the control system 160 operates in response to command signals transmitted from a surface location 164 (see FIG. 1) and received downhole by a sensor 166 which is connected to the control system 160. Various suitable remote control systems may be utilized which are further described below. Generally, the control system 160 and its associated sensor 166 can be described as a remote control means 160 for controlling the control valve means 142 in response to a command signal transmitted from the remote location 164 adjacent the well 12 in which the apparatus 100 is placed.

The control valve means 142 can also be generally described as a pressure transfer control means 142 for controlling communication through the power passage means 132 to the power chamber 104 of the pressure differential between the higher pressure of the compressed gas in second supply chamber portion 124 and the lower pressure of the well fluid in the well annulus 40.

The bypass conduit 138 and bypass check valve means 140 collectively can be referred to as a recharging means 138, 140 operably associated with the high pressure supply chamber 106 for recompressing the volume of compressed gas in the second supply chamber portion 124 when the apparatus 100 is in place at an operational depth within the well 12.

The isolation chamber means 108 including the isolation piston 126 can be described as a means for isolating the power chamber 104 and the bypass conduit means 138 from contact with well fluid in the well annulus 40.

Typically the apparatus 100 will be supplied with a charge of nitrogen gas in the second supply chamber portion 124 sufficient to move the power piston 114 through a plurality of operating cycles An operating cycle of the power piston 114 would be considered to be one complete reciprocation including stroking first in one direction and then back in the other direction through the power chamber 104.

The supply chamber 106 is typically sized so that sufficient oil under pressure can be displaced therefrom to move the power transfer element 114 through a plurality of operating cycles thereof before all of the oil in the first supply chamber portion 122 is depleted. As oil flows out of the supply chamber 106 to move the power piston 114, oil from the low pressure side of the power piston 114 is discharged through discharge check valve 154 and discharge conduit 148 into the first portion 128 of isolation chamber 108.

When the oil in first supply chamber portion 122 is nearly depleted, the nitrogen gas in second supply chamber portion 124 can be repressurized in the following manner. Pressure can be applied to the well annulus 40, or the interior of tubing string 34, whichever is being utilized as the low pressure zone 112, to increase the pressure of a column of fluid standing in either the well annulus 40 or the tubing string 34 until that pressure exceeds the pressure of the nitrogen in second supply chamber portion 124. When this condition occurs, well fluid will flow into the second portion 130 of isolation chamber 108 displacing oil from the first portion 128 of isolation chamber 108 through the bypass conduit 138 and through the bypass check valve means 140 into the first portion 122 of supply chamber 106 thus moving the pressure transfer piston 120 downward as seen in FIG. 2 to recompress the gas in the second supply chamber portion 124.

One advantage of using the rechargeable nitrogen gas powered system is that the power supply chamber 106 can be much smaller in size than it would have to be if it could not be recharged. If the system cannot be recharged, it must contain sufficient hydraulic fluid which can then be discharged under pressure to carry out the required number of operating cycles of the power transfer element 114 and its associated operating element 134.

The apparatus 100 can be completely precharged in which case the gas in second supply chamber portion 124 will be initially pressurized at a gas pressure higher than the hydrostatic downhole pressure in the well annulus 40 at the planned operational depth of the tool, prior to placement of the tool 100 in the well. Alternatively, the gas can be partially precharged, and then subsequently completely pressurized by applying pressure to the well annulus 40 in the manner just described similar to that for recompressing the gas.

Figure 3:
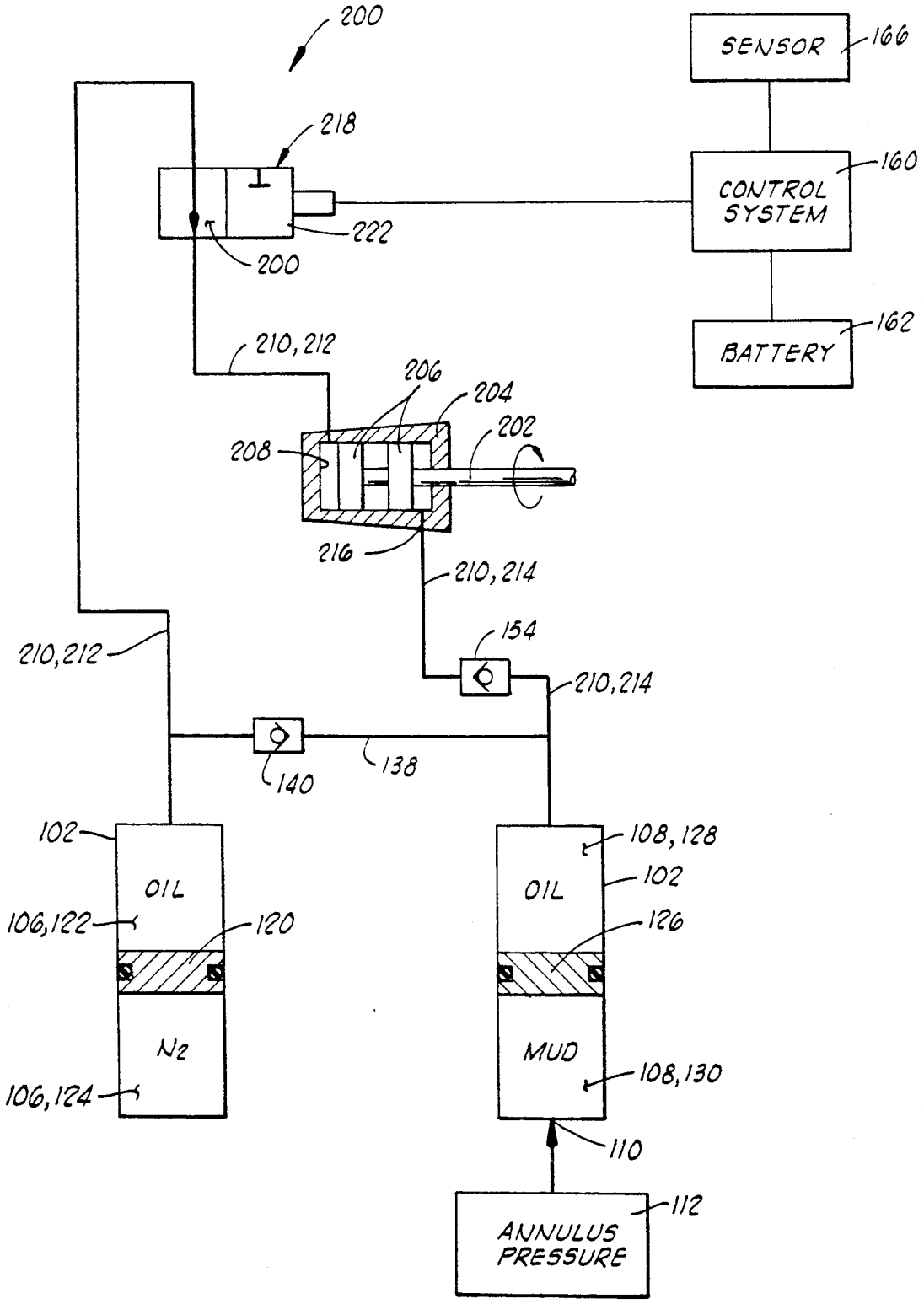
FIG. 3 is a schematic illustration of a system similar to that of FIG. 2 as applied to a rotating power transfer element.

The Embodiment Of FIG. 3

Turning now to FIG. 3, an alternative embodiment of the invention is shown and generally designated by the numeral 200. The downhole tool apparatus 200 is one having a rotatable power transfer element 202 as contrasted to the power piston 114 of FIG. 2. The rotatable power transfer element 202 may for example be the shaft of a hydraulic turbine 204. The shaft 202 is connected to turbine blades schematically illustrated as 206 which are driven by the hydraulic fluid passing thereby through the power chamber 208.

Many of the components of the apparatus 200 shown schematically in FIG. 3 are analogous to those of FIG. 2 and are designated by identical numerals.

In the apparatus 200, the power passage means has been modified as compared to that of FIG. 2 and the power passage means of FIG. 3 is generally designated by the numeral 210. The power passage means 210 includes a high pressure supply passage 212 for communicating high pressure from the first chamber portion 122 of supply chamber 106 to the power chamber 208.

The power passage means 210 also includes a low pressure discharge passage 214 for communicating a low pressure discharge outlet 216 of power chamber 218 with the isolation chamber 108.

The control valve means has also been modified. Instead of the three position control valve 142 seen in FIG. 2, an on/off control valve means 218 is disposed in the high pressure supply passage 212 and has an on position 220 and an off position 222. The on/off valve 218 is controlled by the microprocessor based control system 160 which is analogous to that previously described.

With regard to the rotating power transfer element 202, one revolution thereof can be generally described as an operating cycle of the rotating power transfer element 202.

Techniques For Remote Control

Many different systems can be utilized to send command signals from the surface location 164 down to the sensor 166 to control the tools 100 or 200.

One suitable system is the signaling of the control package 160, and receipt of feedback from the control package 160, using acoustical communication which may include variations of signal frequencies, specific frequencies, or codes of acoustical signals or combinations of these. The acoustical transmission media includes tubing string, casing string, electric line, slick line, subterranean soil around the well, tubing fluid, and annulus fluid. An example of a system for sending acoustical signals down the tubing string is seen in U.S. Pat. Nos. 4,375,239; 4,347,900; and 4,378,850 all to Barrington and assigned to the assignee of the present invention.

A second suitable remote control system is the use of a mechanical or electronic pressure activated control package 160 which responds to pressure amplitudes, frequencies, codes or combinations of these which may be transmitted through tubing fluid, casing fluid, fluid inside coiled tubing which may be transmitted inside or outside the tubing string, and annulus fluid.

A third remote control system which may be utilized is radio transmission from the surface location or from a subsurface location, with corresponding radio feedback from the tools 100 or 200 to the surface location or subsurface location.

A fourth possible remote control system is the use of microwave transmission and reception.

A fifth type of remote control system is the use of electronic communication through an electric line cable suspended from the surface to the downhole control package.

A sixth suitable remote control system is the use of fiberoptic communications through a fiberoptic cable suspended from the surface to the downhole control package.

A seventh possible remote control system is the use of acoustic signaling from a wire line suspended transmitter to the downhole control package with subsequent feedback from the control package to the wire line suspended transmitter/receiver. Communication may consist of frequencies, amplitudes, codes or variations or combinations of these parameters.

An eighth suitable remote communication system is the use of pulsed X-ray or pulsed neutron communication systems.

As a ninth alternative, communication can also be accomplished with the transformer coupled technique which involves wire line conveyance of a partial transformer to a downhole tool. Either the primary or secondary of the transformer is conveyed on a wire line with the other half of the transformer residing within the downhole tool. When the two portions of the transformer are mated, data can be interchanged.

All of the systems described above may utilize an electronic control package 160 that is microprocessor based.

It is also possible to utilize a preprogrammed microprocessor based control package 160 which is completely self-contained and is programmed at the surface to provide a pattern of operation of the downhole tool which it controls. For example, a remote control signal from the surface could instruct the microprocessor based electronic control package 160 to start one or more preprogrammed sequences of operations. Also, the preprogrammed sequence could be started in response to a sensed downhole parameter such as bottom hole pressure. Such a self-contained system may be constructed in a manner analogous to the self-contained downhole gauge system shown in U.S. Pat. No. 4,866,607. to Anderson et al., and assigned to the assignee of the present invention, which is incorporated herein by reference.

Methods Of Operation

The methods of operation of the downhole tool apparatus 100 or 200 are generally as follows.

First, it should be noted that either of the apparatus 100 or 200 can be used in one of two general techniques. Either the nitrogen supplied to the second supply chamber portion 124 can be completely precharged prior to placement of the apparatus in the well, or it can be partially precharged and then further charged after the apparatus reaches operational depth in the well. In either event, the nitrogen can subsequently be recharged with the tool remaining in the well.

To first describe the situation in which the apparatus is fully precharged, and describing the same with regard to the apparatus 100 of FIG. 2, the apparatus will be intended for use at an operational depth in the well 12. For example, if the apparatus 100 is in the position of tester valve 60 in FIG. 1, that apparatus is shown at operational depth 224. Assuming that the low pressure reference zone to be utilized is the well annulus 40, the hydrostatic downhole pressure of the annulus 40 at depth 224 can be measured or otherwise determined. Knowing that hydrostatic downhole pressure, which will serve as the low pressure reference for the tool, the nitrogen in second chamber portion 124 of supply chamber 106 will be initially pressurized at a gas pressure higher than the hydrostatic downhole pressure at depth 224 prior to placement of the tool in the well.

Then the apparatus 100 is conveyed on the testing string 34 to its operational depth 224 within the well 12.

When it is desired to open or close the formation tester valve operating element 134, an appropriate command signal is sent from surface location 164 and is sensed by sensor 166. The control system 160 in response to this sensed signal will then cause the control valve 142 to move to either its first or second position 156 or 158 thus supplying hydraulic fluid power from the supply chamber 106 to the power piston 114 and moving the power piston 114. This can be repeated to move the power piston 114 through a relatively large number of operating cycles thereof before the hydraulic fluid contained in the first portion 122 of power supply chamber 106 is depleted.

As the power piston 114 is operated a number of times to open and close the valve 134, the oil supply in the second chamber portion 122 of power chamber 106 will gradually be depleted as the nitrogen gas in second chamber portion 124 expands and the pressure transfer piston 120 moves upward within the chamber illustrated in FIG. 2. Simultaneously, an equal amount of hydraulic fluid will be discharged into the first chamber portion 128 of isolation chamber 108.

When the first chamber 122 of supply chamber 106 nears depletion, the power chamber 106 can be recharged while the tool 100 is still located at its operational depth 224 in the well 12. The control valve 142 is preferably placed in its closed position 144. Then pressure in the well annulus 40 is increased by applying pressure to the upper end of the column of annulus fluid standing in the well annulus 40 until the downhole annulus pressure is greater than the pressure of the gas in power chamber 106. At that time, well fluid will enter the second portion 130 of isolation chamber 108 through port 110 thus forcing the isolation piston 126 upward and forcing oil out of the first portion 128 of isolation chamber 108 through the bypass conduit 138 and bypass check valve 140 into the first portion 122 of power chamber 106. As the oil flows into the first portion 122 of power chamber 106, it forces the pressure transfer piston 120 downward thus recompressing the nitrogen gas contained in the second portion 124 of power chamber 106. Once this has been accomplished, the excess pressure which is being applied to the well annulus 40 is released so that the well annulus 40 will return to hydrostatic conditions. Then, the apparatus 100 is again ready for use as the high pressure fluid supply in chamber 106 has been completely recharged. This recharging step can of course be repeated any number of times as necessary.

The apparatus 100 can also be constructed so that the port 110 communicates with the interior of the tubing string 34 so that the interior of tubing string 34 defines the low pressure zone 112. In that instance, the high pressure supply chamber 106 can be recharged by applying pressure to the fluid in testing string 34.

During normal operation utilizing the high pressure supply chamber 106, fluid flow and fluid pressure communication through the bypass conduit 138 is prevented by the bypass check valve means 140.

Also, the isolation chamber 108, and particularly the isolation piston 126, isolates the power piston 114 from contaminating contact with well fluids from the well annulus 40.

The second manner in which the apparatus 100 can be utilized is to pressurize the nitrogen gas in chamber portion 124 of supply chamber 106 only sufficiently to provide a sufficient mass of nitrogen gas in the chamber for subsequent operation of the tool. The initial precharge need not be as high as the hydrostatic pressure in the well at operating depth 224. The apparatus 100 can then be conveyed to the operating depth 224 as part of the testing string 34. Then prior to operation of the apparatus 100, the gas in second chamber portion 124 can be further compressed by pressurizing the well annulus. A full initial operating charge is not supplied to the gas in second chamber portion 124 until it is located at its operational depth 224 within the well 12. One advantage of this procedure is that the pressure of the gas in the tool while it is in the vicinity of human operators on the work deck 26 is minimized thus minimizing the dangers which are inherent in tools containing high pressure gases.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A downhole tool apparatus, comprising:

a housing having a power chamber, a supply chamber and an isolation chamber defined therein, and having port means defined therein for communicating said isolation chamber with a low pressure zone of a well;

a power transfer element disposed in said power chamber;

a pressure transfer piston slidably disposed in said supply chamber and dividing said supply chamber into first and second portions, said second portion being filled with compressed gas to provide a high pressure source;

an isolation piston slidably disposed in said isolation chamber and dividing said isolation chamber into first and second portions, said second portion being in fluid flow communication through said port means with said low pressure zone of said well; and power passage means for communicating said power chamber with said first portion of said supply chamber and with said first portion of said isolation chamber, so that a pressure differential between said high pressure source and said low pressure zone of said well is applied to said power transfer element to operate said downhole tool apparatus.

2. The apparatus of claim 1, further comprising:

bypass conduit means for bypassing said power chamber and directly communicating said first portions of said supply chamber and said isolation chamber with each other; and bypass check valve means, disposed in said bypass conduit means, for permitting flow of hydraulic fluid from said first portion of said isolation chamber through said bypass conduit means to said first portion of said supply chamber to recompress said compressed gas when fluid pressure in said low pressure zone of said well is increased to a level greater than the pressure of said compressed gas.

3. The apparatus of claim 1, wherein:

said power chamber, said first portion of said supply chamber, said first portion of said isolation chamber, and said power passage means are all filled with a clean hydraulic fluid.

4. The apparatus of claim 1, wherein:

said power passage means includes a high pressure supply passage for communicating high pressure from said supply chamber to said power chamber, and a low pressure discharge passage for communicating said power chamber with said isolation chamber; and said apparatus further includes a discharge check valve means disposed in said discharge passage for preventing flow of hydraulic fluid from said isolation chamber toward said power chamber.

5. The apparatus of claim 1, further comprising:

control valve means, disposed in said power passage means, for controlling communication of said power chamber with said supply chamber.

6. The apparatus of claim 5, wherein:

said power transfer element includes a power piston slidably disposed in said power chamber and dividing said power chamber into first and second portions; and said control valve means has a first position wherein said first portion of said supply chamber is communicated with said first portion of said power chamber, and said second portion of said power chamber is communicated with said first portion of said isolation chamber so that said pressure differential acts in a first direction across said power piston; and said control valve means has a second position wherein said first portion of said supply chamber is communicated with said second portion of said power chamber, and said first portion of said power chamber is communicated with said first portion of said isolation chamber so that said pressure differential acts in a second direction, opposite said first direction, across said power piston.

7. The apparatus of claim 6, wherein:

said control valve means has a third position wherein said power chamber is isolated from said supply chamber and said isolation chamber.

8. The apparatus of claim 5, wherein:

said power passage means includes a high pressure supply passage for communicating high pressure from said supply chamber to said power chamber, and a low pressure discharge passage for communicating said power chamber with said isolation chamber;

said power transfer element is a rotatable power transfer element; and said control valve means is an on/off valve disposed in said high pressure supply passage.

9. The apparatus of claim 8, further comprising:

a discharge check valve means disposed in said discharge passage for preventing flow of hydraulic fluid from said isolation chamber toward said power chamber.

10. The apparatus of claim 5, further comprising:

remote control means for controlling said control valve means in response to a command signal transmitted from a remote location adjacent said well in which said apparatus is placed.

11. The apparatus of claim 1, wherein:

said low pressure zone of said well is a well annulus surrounding said housing.

12. The apparatus of claim 1, wherein:

said low pressure zone of said well is an interior of a tubing string upon which said apparatus is conveyed into said well.

13. A downhole tool apparatus for use at an operational depth in a well, said well having a hydrostatic downhole pressure at said operational depth, comprising:

a housing having a power chamber and a high pressure supply chamber defined therein, said high pressure supply chamber containing a volume of compressed gas initially pressurized at a gas pressure higher than said hydrostatic downhole pressure prior to placement of said apparatus in said well;

power passage means for providing fluid pressure communication between said power chamber and said high pressure supply chamber and between said power chamber and a well annulus surrounding said housing; and pressure transfer control means for controlling communication through said power passage means to said power chamber of a pressure differential between said higher pressure of said compressed gas in said high pressure supply chamber and a lower pressure of well fluid in said well annulus.

14. The apparatus of claim 13, further comprising:

recharging means, operably associated with said high pressure supply chamber, for recompressing said volume of compressed gas when said apparatus is at said operational depth in said well.

15. The apparatus of claim 14, wherein said recharging means comprises:

bypass conduit means for bypassing said power chamber and directly communicating said high pressure supply chamber with said well annulus; and bypass check valve means, disposed in said bypass conduit means, for permitting fluid pressure to be communicated from said well annulus through said bypass conduit means to said high pressure supply chamber to recompress said compressed gas when annulus pressure in said well annulus is increased to a level greater than the pressure of said compressed gas.

16. The apparatus of claim 15, further comprising:

isolation chamber means, disposed in said power passage means, for isolating said power chamber and said bypass conduit means from contact with well fluid from said well annulus.

17. A downhole tool apparatus, comprising:

a housing having a power chamber and a high pressure supply chamber defined therein, said high pressure supply chamber containing a volume of compressible fluid;

power passage means for providing fluid pressure communication between said power chamber and said high pressure supply chamber and between said power chamber and a low pressure zone of a well;

bypass conduit means for bypassing said power chamber and communicating said high pressure supply chamber with said low pressure zone of said well; and bypass check valve means, disposed in said bypass conduit means, for preventing fluid pressure from being communicated from said high pressure supply chamber through said bypass conduit means to said low pressure zone of said well when the pressure of said compressible fluid is greater than pressure in said low pressure zone of said well, and for permitting fluid pressure to be communicated from said low pressure zone of said well through said bypass conduit means to said high pressure supply chamber to compress said volume of compressible fluid when pressure in said low pressure zone of said well is greater than the pressure of said compressible fluid.

18. The apparatus of claim 17, wherein:

said compressible fluid is a gas.

19. The apparatus of claim 17, further comprising:

pressure transfer control means for controlling communication through said power passage means to said power chamber of a pressure differential between a higher pressure of said compressible fluid in said high pressure supply chamber and a lower pressure in said low pressure zone of said well.

20. The apparatus of claim 19, further comprising:

a power transfer element disposed in said power chamber; and wherein said pressure transfer control means is further characterized as a means for moving said power transfer element through a plurality of operating cycles during a single expansion of said volume of compressible fluid.

21. The apparatus of claim 17, further comprising:

isolation chamber means, disposed in said power passage means, for isolating said power chamber and said bypass conduit means from contact with well fluid from said low pressure zone of said well.

22. The apparatus of claim 17, wherein said low pressure zone of said well is a well annulus surrounding said housing.

23. The apparatus of claim 17, wherein:

said low pressure zone of said well is an interior of a tubing string.

24. A downhole tool apparatus, comprising:

a power transfer element;

power supply means for supplying operating power to said power transfer element for a plurality of operating cycles of said power transfer element; and recharging means, operably associated with said power supply means, for recharging said power supply means while said apparatus is downhole in a well.

25. The apparatus of claim 24, wherein:

said power supply means includes a high pressure supply chamber;

said power transfer element is actuated by a pressure differential between a higher pressure in said high pressure supply chamber and a lower pressure in a low pressure zone of said well; and said recharging means is a means for recharging said high pressure supply chamber.

26. The apparatus of claim 25, wherein:

said low pressure zone of said well is a well annulus surrounding said apparatus.

27. The apparatus of claim 25, wherein:

said low pressure zone of said well is an interior of a tubing string upon which said apparatus is conveyed into said well.

28. The apparatus of claim 25, wherein said recharging means comprises:

bypass conduit means for bypassing said power transfer element and communicating said high pressure supply chamber with said low pressure zone of said well; and bypass check valve means, disposed in said bypass conduit means, for permitting fluid pressure to be communicated from said low pressure zone of said well through said bypass conduit means to said high pressure supply chamber when fluid pressure in said low pressure zone of said well is greater than fluid pressure in said high pressure supply chamber.

29. The apparatus of claim 28, wherein:

said bypass check valve means is further characterized as a means for preventing fluid pressure from being communicated from said high pressure supply chamber through said bypass conduit means to said low pressure zone of said well when fluid pressure in said high pressure supply chamber is greater than fluid pressure in said low pressure zone of said well.

30. A method of operating a downhole tool in a well, comprising:

(a) conveying said downhole tool to an operational depth within said well, said tool including a power transfer element and a power supply;

(b) supplying power from said power supply to said power transfer element and moving said power transfer element through a plurality of operating cycles thereof; and (c) charging said power supply while said downhole tool is at said operational depth in said well.

31. The method of claim 30, further comprising:

repeating said step (c) as necessary.

32. The method of claim 30, wherein:

said step (c) is first performed after said step (b) so that step (c) is further characterized as recharging said power supply.

33. The method of claim 30, wherein:

said step (c) is first performed before said step (b) so that step (c) when first performed is further characterized as providing an initial precharge to said power supply.

34. The method of claim 30, wherein:

said step (c) includes a step of applying pressure to the surface of a column of fluid standing in said well.

35. The method of claim 34, wherein:

said column of fluid is well annulus fluid.

36. The method of claim 34, wherein:

said column of fluid is tubing fluid in an interior of a tubing string upon which said downhole tool was conveyed into said well in step (a).

37. The method of claim 34, wherein:

said step (a) is further characterized in that said power supply includes a high pressure supply chamber containing a volume of compressed gas; and said step (c) is further characterized as communicating said applied pressure through said column of fluid to said compressed gas to further compress said gas.

38. The method of claim 37, further comprising:

preventing fluid pressure communication from said volume of compressed gas to said column of fluid other than across said power transfer element so long as the pressure of said compressed gas is greater than the pressure of said column of fluid at said operational depth.

39. The method of claim 34, further comprising:

isolating said power transfer element from contact with well fluid from said column of fluid.

40. A method of moving a power transfer element of a downhole tool in a well, said tool including a high pressure supply chamber containing a volume of compressed gas, comprising:

(a) conveying said downhole tool to an operational depth within said well;

(b) applying a pressure differential between said high pressure supply chamber and a low pressure zone of said well to said power transfer element; and (c) thereby moving said power transfer element through a plurality of operating cycles thereof.

41. The method of claim 40, further comprising:

(d) after step (c), and while maintaining said downhole tool at said operational depth, recompressing said volume of compressed gas and thereby recharging said high pressure supply chamber; and (e) repeating step (d) as necessary.

42. The method of claim 41, wherein:

said step (d) includes a step of applying pressure to the upper end of a column of fluid standing in said well and communicated with said low pressure zone of said well.

43. The method of claim 40, further comprising:

between said steps (a) and (b), and while maintaining said downhole tool at said operational depth, further compressing said volume of compressed gas and thereby providing an initial operating charge to said high pressure supply chamber.

44. The method of claim 40, wherein:

said step (b) is further characterized in that said low pressure zone of said well is a well annulus surrounding said downhole tool.

45. The method of claim 40, wherein:

said step (b) is further characterized in that said low pressure zone of said well is an interior of a tubing string upon which said downhole tool was conveyed into said well in said step (a).

* * * * *